US007557516B2

(12) United States Patent
Yang et al.

(10) Patent No.: US 7,557,516 B2
(45) Date of Patent: Jul. 7, 2009

(54) RESONANT INVERTER

(75) Inventors: Ta-yung Yang, Milpitas, CA (US); Jea-Sen Lin, Taipei County (TW)

(73) Assignee: System General Corp., Taipei (TW)

( * ) Notice: Subject to any disclaimer, the term of this patent is extended or adjusted under 35 U.S.C. 154(b) by 0 days.

(21) Appl. No.: 11/688,881

(22) Filed: Mar. 21, 2007

(65) Prior Publication Data

US 2008/0231205 A1 Sep. 25, 2008

(51) Int. Cl.
*H05B 41/16* (2006.01)

(52) U.S. Cl. ..... 315/274; 315/276; 315/291; 315/307; 315/224

(58) Field of Classification Search ..... 315/187, 315/188, 220, 219, 209 R, 224, 225, 291, 315/307, 297, 276, 274, 279
See application file for complete search history.

(56) References Cited

U.S. PATENT DOCUMENTS

| | | | | |
|---|---|---|---|---|
| 6,642,670 | B2 * | 11/2003 | Zhang et al. | 315/247 |
| 6,784,626 | B2 * | 8/2004 | Otake et al. | 315/291 |
| 2002/0113556 | A1 * | 8/2002 | Tao et al. | 315/219 |
| 2004/0130273 | A1 * | 7/2004 | Alexandrov | 315/291 |

* cited by examiner

*Primary Examiner*—Tuyet Vo
(74) *Attorney, Agent, or Firm*—Jianq Chyun IP Office

(57) ABSTRACT

The present invention provides a low-cost inverter for ballast. A current transformer is connected in series with a lamp to operate the lamp. A first transistor and a second transistor are coupled to switch the resonant circuit. The current transformer is utilized to generating control signals in response to the switching current of the resonant circuit. The transistor is turned on once the control signal is higher than a first threshold. After that, the transistor is turned off once the control signal is lower than a second threshold. Therefore, a soft switching operation for the first transistor and the second transistor can be achieved.

12 Claims, 5 Drawing Sheets

RESONANT INVERTER

BACKGROUND OF THE INVENTION

1. Field of the Invention

The present invention relates in general to a resonant circuit, and more particularly to a resonant inverter and ballast.

2. Description of Related Art

Fluorescent lamps are the most popular light sources in our daily lives. Improving the efficiency of fluorescent lamps significantly saves energy. Therefore, in recent development, how to improve the efficiency and save the power for the ballast of fluorescent lamps is a major concern.

FIG. 1 shows a conventional inverter circuit with a serially connected resonant circuit for an electronic ballast circuit. A half-bridge inverter consists of two switches 10 and 15. The two switches 10 and 15 are complementarily switched on and off with 50% duty cycle at a desired switching frequency. The resonant circuit is composed of an inductor 75 and a capacitor 70 to operate a fluorescent lamp 50. The fluorescent lamp 50 is connected in parallel with a capacitor 55. The capacitor 55 is operated as a start-up circuit. Once the fluorescent lamp 50 is started up, the switching frequency is controlled to produce a required lamp voltage. A controller 5 is utilized to generate switching signals $S_1$ and $S_2$ to drive switches 10 and 15 respectively. The switch 10 is connected to a high voltage source V+. The controller 5 is thus required to include a high-side switch driver to turn on/off the switch 10, which increases the cost of the ballast circuit. Another drawback of this circuit is high switching loss on switches 10 and 15. The parasitic devices of the fluorescent lamp 50, such as the equivalent capacitance, etc., are changed in response to temperature variation and the age of the fluorescent lamp 50. Besides, the inductance of the inductor 75 and the capacitance of the capacitor 70 are varied during the mass production process. The objective of the present invention is to provide a low cost inverter circuit that can automatically achieve soft switching for reducing the switching loss and improving the efficiency of the ballast.

SUMMARY OF THE INVENTION

The present invention provides an inverter circuit for ballast circuits. A lamp is connected in series with a transformer to develop a resonant circuit. A first transistor and a second transistor are coupled to the resonant circuit for switching the resonant circuit. A first control circuit and a second control circuit are coupled to control the first transistor and the second transistor respectively. The transformer is utilized to provide power sources and generate control signals for the first control circuit and the second control circuit in response to the switching current of the resonant circuit. The transistor is turned on once the control signal is higher than a first-threshold. The transistor is turned off once the control signal is lower than a second-threshold. The first transistor and the second transistor therefore perform the soft switching.

BRIEF DESCRIPTION OF ACCOMPANIED DRAWINGS

The accompanying drawings are included to provide a further understanding of the present invention, and are incorporated in and constitute a part of this specification. The drawings illustrate embodiments of the present invention and, together with the description, serve to explain the principles of the present invention.

FIG. 3~FIG. 6 respectively shows the first operation phase to the fourth operation phase of the current mode resonant inverter according to the present invention.

Figure 7:
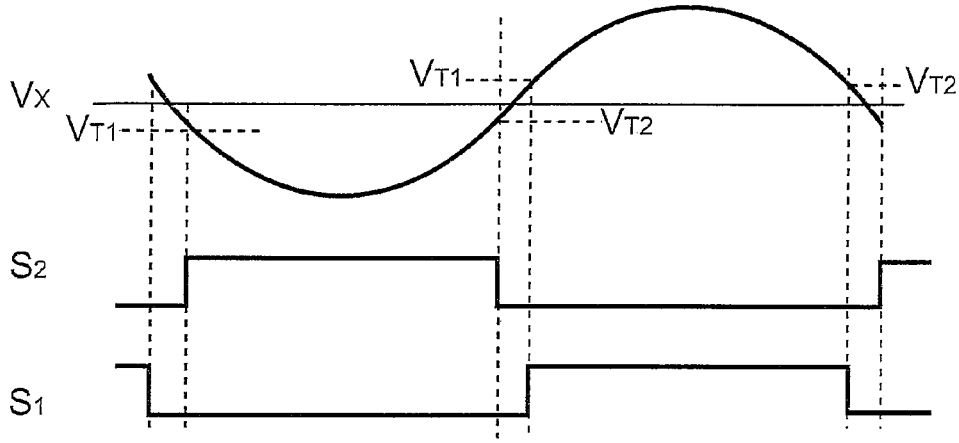

FIG. 7 shows the waveform of the current mode resonant inverter in four operation phases according to the present invention.

Figure 8:
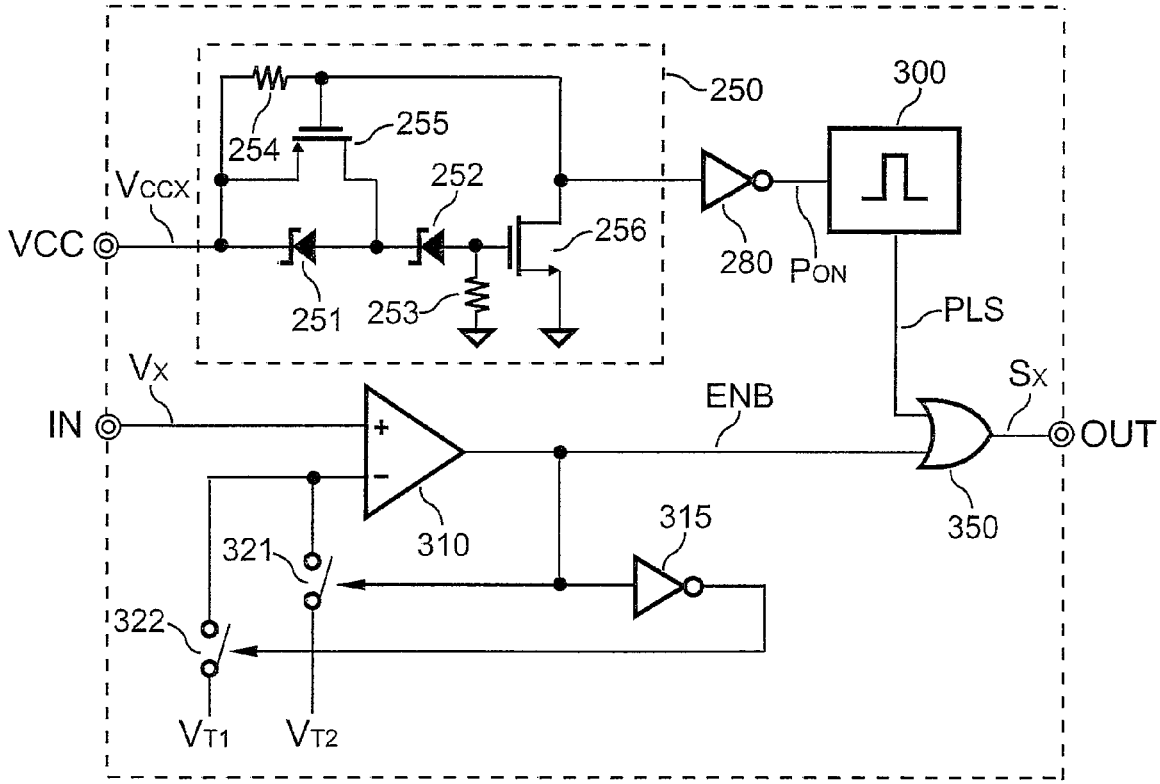

FIG. 8 shows an embodiment of the control circuit according to the present invention.

Figure 9:
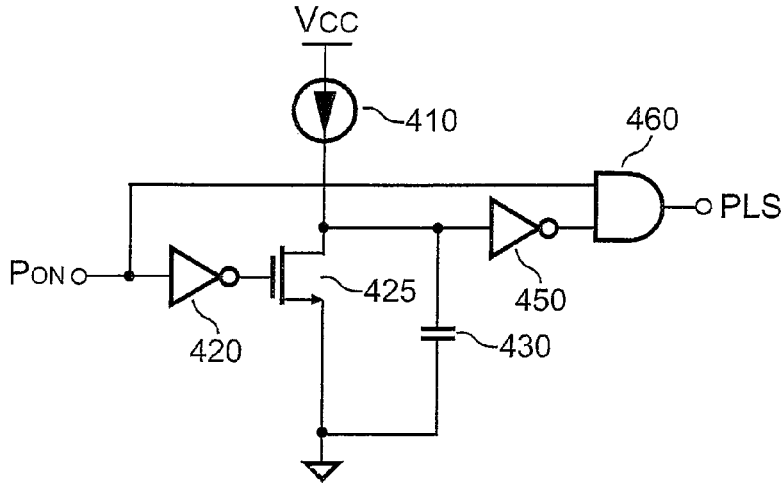

FIG. 9 shows an embodiment of a one-shot circuit.

Figure 10:
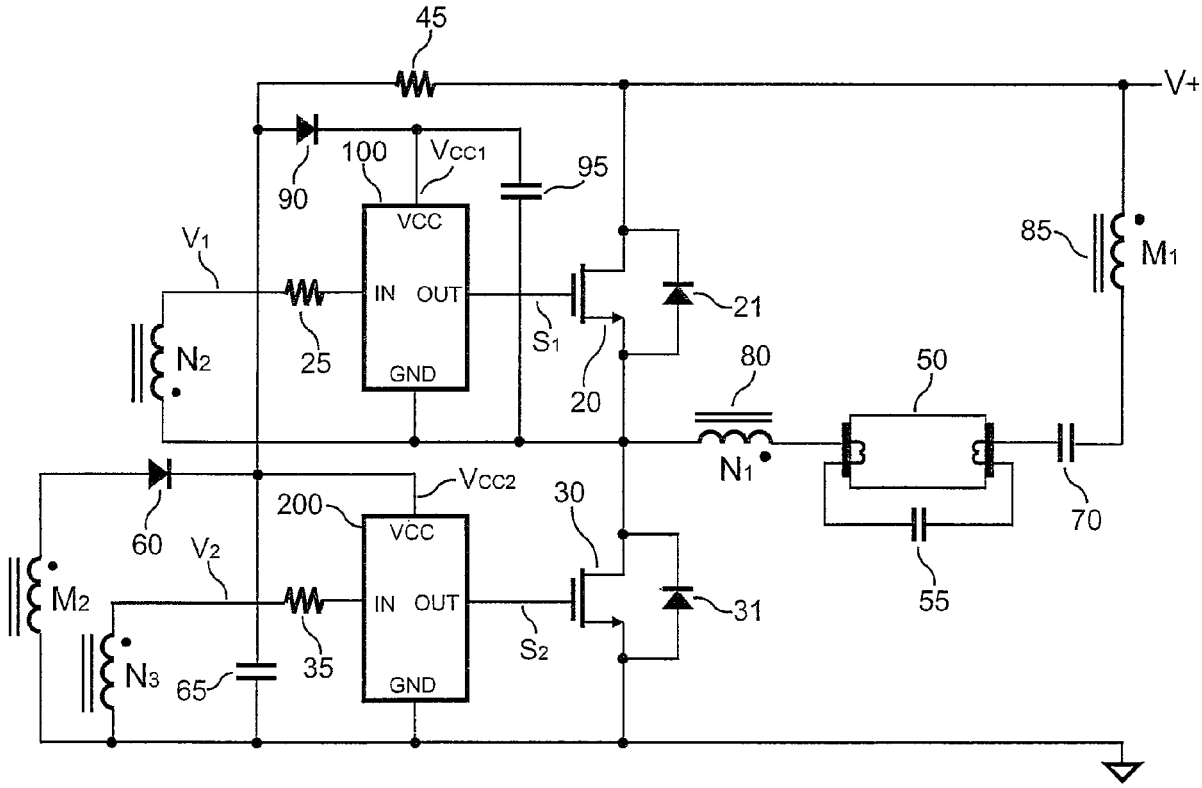

FIG. 10 shows another embodiment of the current mode resonant inverter according to present invention.

DESCRIPTION OF THE PREFERRED EMBODIMENT

Figure 1:
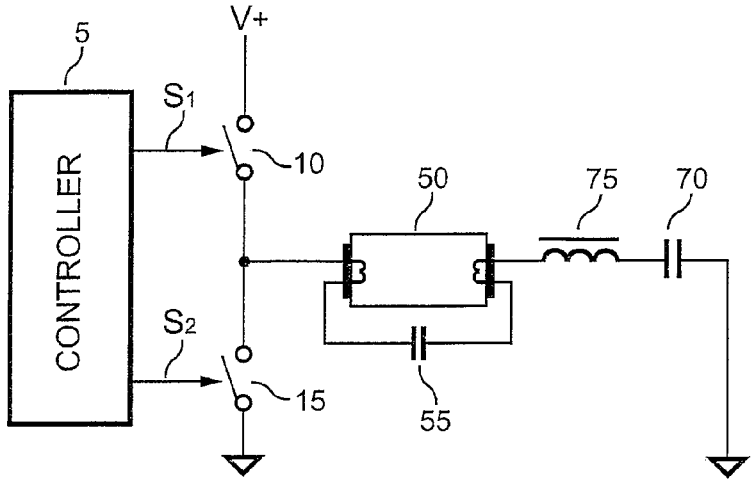
FIG. 1 (Prior Art)
FIG. 1 shows a conventional electronic ballast circuit.
Figure 2:
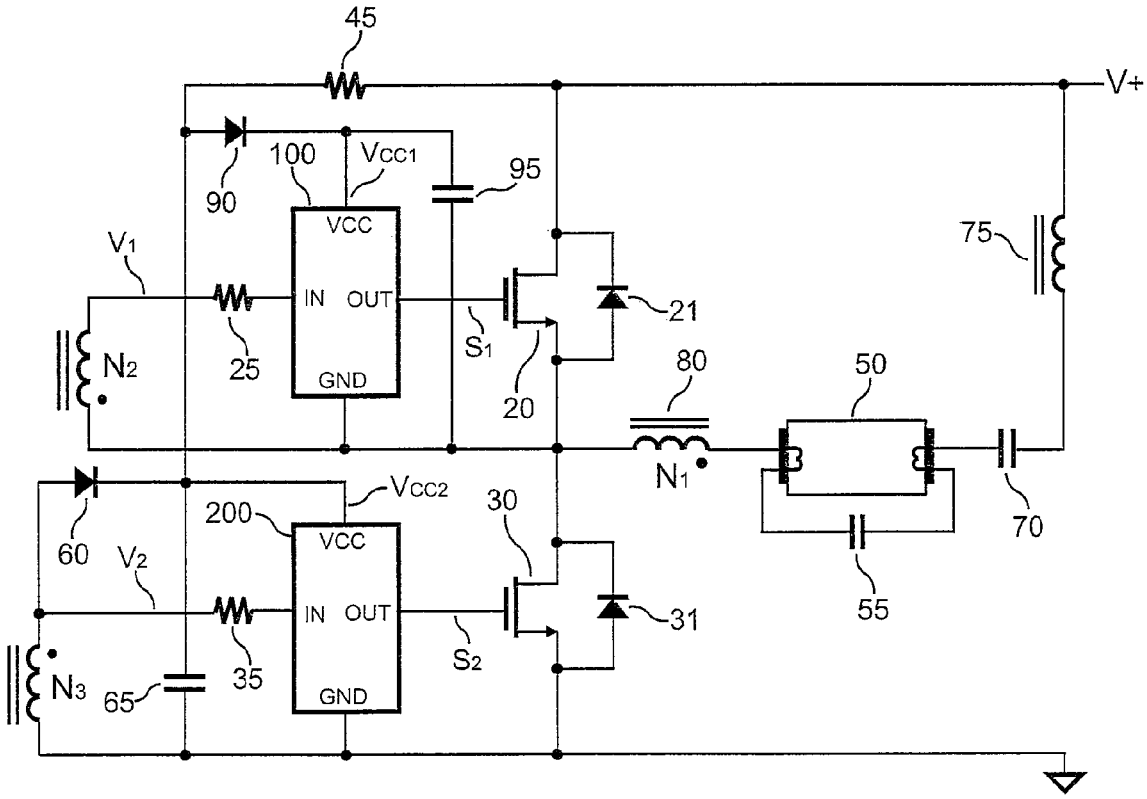
FIG. 2 is an embodiment of a current mode resonant inverter according to the present invention.

FIG. 2 shows a schematic diagram of a current mode resonant inverter according to an embodiment of the present invention. A resonant circuit consists of a capacitor 70 and an inductor 75 connected in series with each other to operate a lamp 50 which is a load of the current mode resonant inverter. The resonant circuit produces a sine wave current to operate the lamp 50. A first transistor 20 is coupled to switch the resonant circuit. The first transistor 20 is controlled by a first switching signal $S_1$. A second transistor 30 is coupled to switch the resonant circuit as well. The second transistor 30 is controlled by a second switching signal $S_2$. A first winding $N_1$ of a transformer 80 is connected in series with the lamp 50. The transformer 80 is a current transformer. Therefore, a second winding $N_2$ and a third winding $N_3$ of the transformer 80 are used for generating a first control signal $V_1$ and a second control signal $V_2$ in response to the switching current of the resonant circuit. The first control signal $V_1$ is coupled to an input terminal IN of a first control circuit 100 via a first resistor 25. The second control signal $V_2$ is coupled to an input terminal IN of a control circuit 200 via a resistor 35. A diode 21 is connected in parallel with the first transistor 20. A diode 31 is connected in parallel with the second transistor 30. The first control circuit 100 generates the first switching signal $S_1$ for turning on/off the first transistor 20 in response to the waveform of the first control signal $V_1$. The second control circuit 200 generates the second switching signal $S_2$ for turning on/off the second transistor 30 in response to the waveform of the second control signal $V_2$.

Once the power is applied to the current mode resonant inverter, an input voltage V+ charges a capacitor 65 via a third resistor 45. The capacitor 65 further provides a supply voltage $V_{CC2}$ to a power terminal VCC of the second control circuit 200. As the voltage across the capacitor 65 is higher than a start-up threshold, the second control circuit 200 will start to operate. A diode 60 is coupled from the third winding $N_3$ of the transformer 80 to the capacitor 65 to further power the second control circuit 200 once the switching of the resonant circuit starts. A diode 90 and a capacitor 95 form a charge-pump circuit. The charge-pump circuit is coupled to the capacitor 65 to provide another supply voltage $V_{CC1}$ to the first control circuit 100.

FIG. 3~FIG. 6 show operation phases of the current mode resonant inverter.

Figure 3:
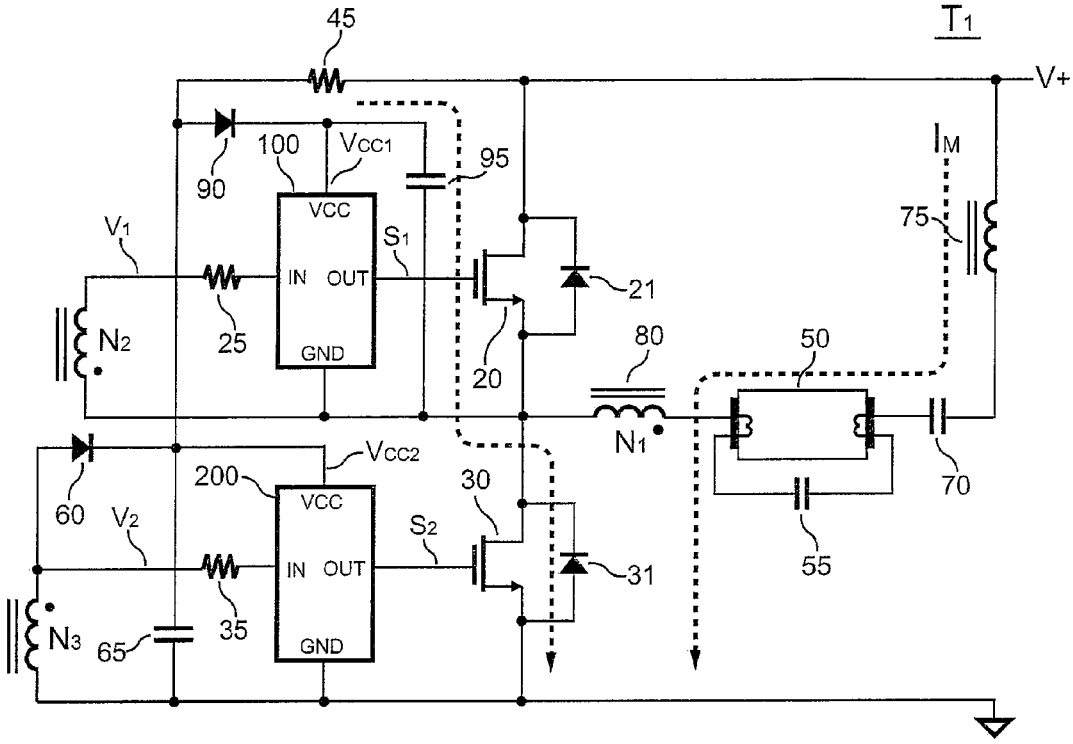
Figure 4:
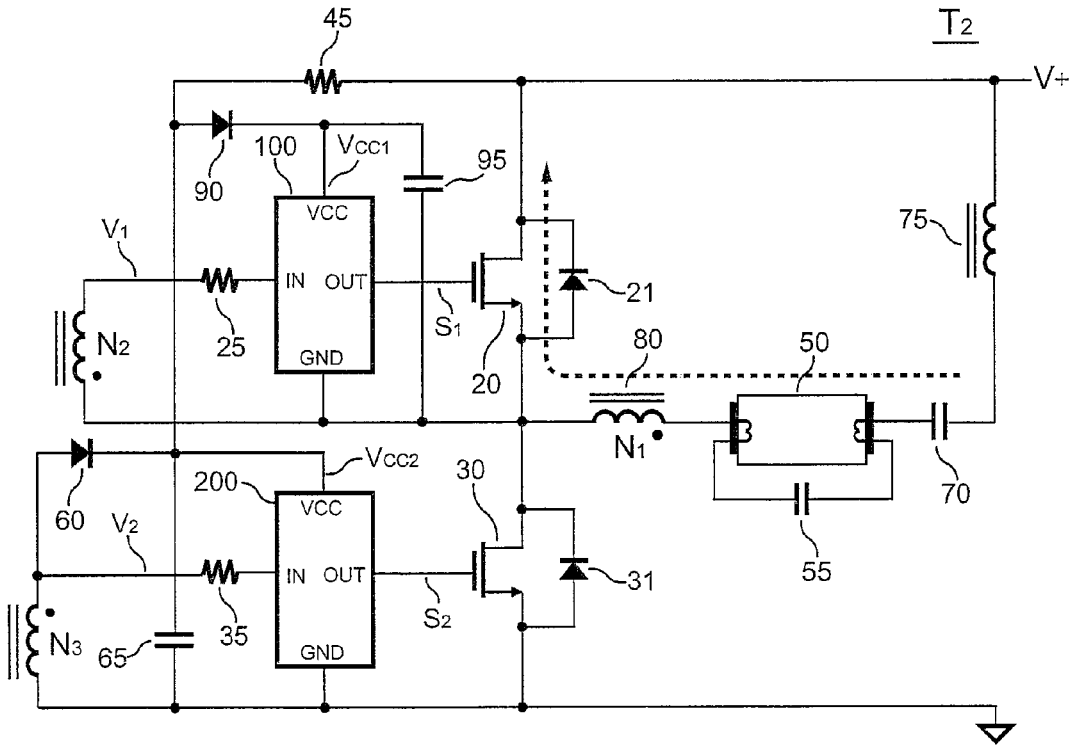
Figure 5:
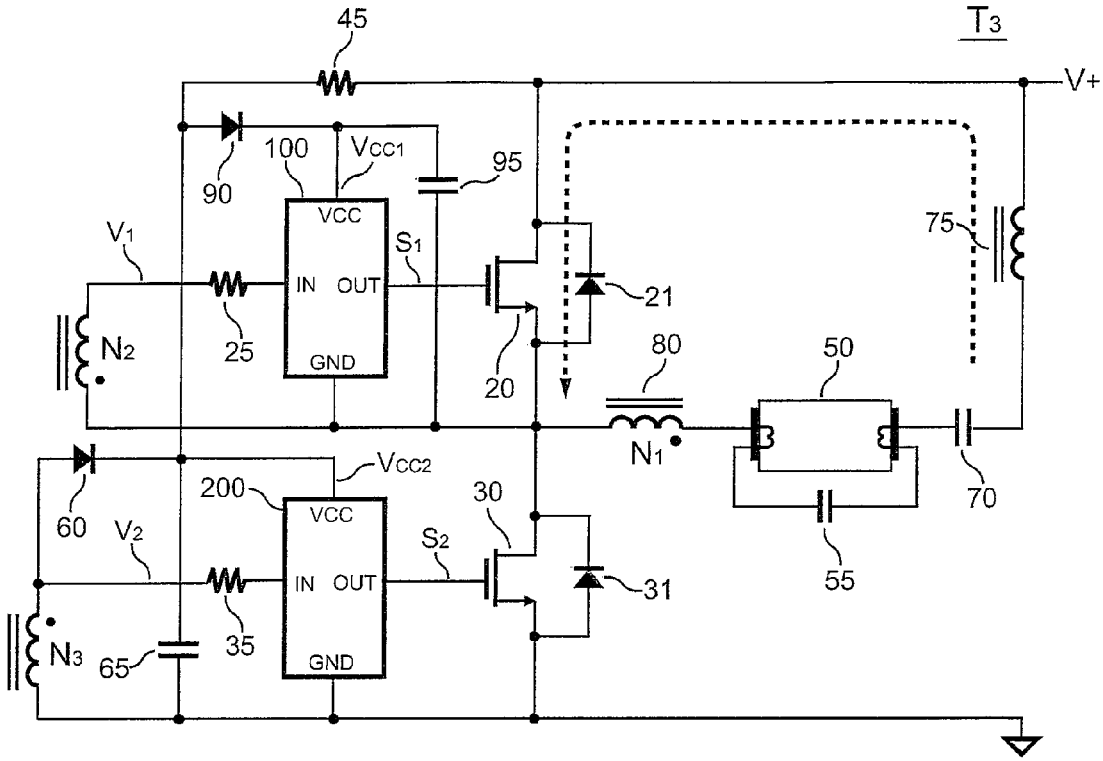
Figure 6:
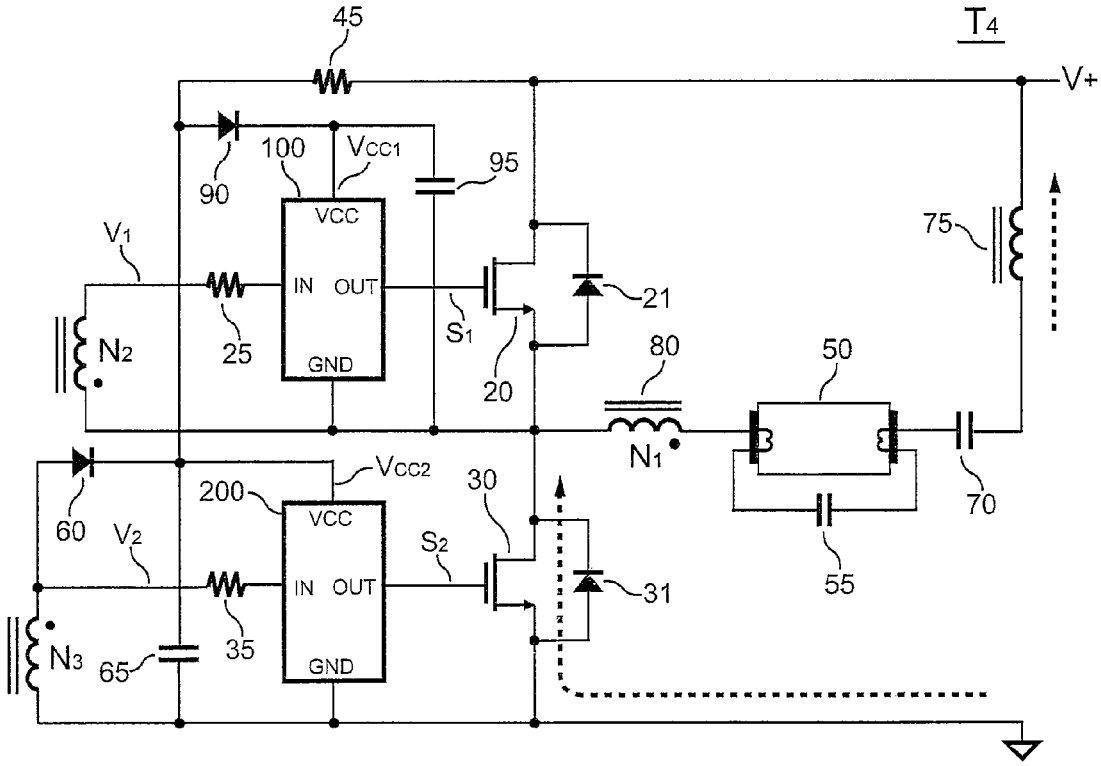

FIG. 3 shows the first operation phase $T_1$ of the current mode resonant inverter. When the second transistor 30 is turned on, a switching current $I_M$ will flow via the transformer 80 to generate the second control voltage $V_2$. Meanwhile, the capacitor 65 is charged via the diode 60. Once the switching current $I_M$ decreases and the second control voltage $V_2$ is lower than a second threshold $V_{T2}$, the second transistor 30 will be turned off. After that, the circular current of the resonant circuit will turn on the diode 21. The circular current is produced by the energy stored in the inductor 75. The energy of the resonant circuit will be circulated (the second operation phase $T_2$). The switching current $I_M$ flowing via the transformer 80 will generate the first control signal $V_1$. If the first control signal $V_1$ is higher than a first threshold $V_{T1}$, the first control circuit 100 will enable the first switching signal $S_1$ to turn on the first transistor 20. Since the diode 21 is conducted at this moment, turning on the transistor 20 achieves soft switching operation (the third operation phase $T_3$). When the switching current $I_M$ decreases and the first control voltage $V_1$ is lower than the second threshold $V_{T2}$, the first transistor 20 will be turned off. Meanwhile, the circular current of the resonant circuit will turn on the diode 31 (the fourth operation phase $T_4$). Therefore, turning on the second transistor 30 also achieves the soft switching operation.

FIG. 7 shows the waveform of the current mode resonant inverter in four operation stages, in which $V_X$ represents control signals $V_1$ and $V_2$. The first switching signal $S_1$ is enabled once the first control signal $V_1$ is higher than the first threshold $V_{T1}$. After a quarter resonant period of the resonant circuit, the first switching signal $S_1$ is disabled once the first control signal $V_1$ is lower than the second threshold $V_{T2}$. The resonant frequency $f_R$ of the resonant circuit is given by, $$f_R = \frac{1}{2\pi\sqrt{LC}} \tag{1}$$

where the L is the inductance of the inductor 75; and C is the equivalent capacitance of the lamp 50 and the capacitor 70.

The second switching signal $S_2$ is enabled once the second control signal $V_2$ is higher than the first threshold $V_{T1}$. Besides, after a quarter resonant period of the resonant circuit, the second switching signal $S_2$ is disabled once the second control signal $V_2$ is lower than the second threshold $V_{T2}$.

FIG. 8 shows an embodiment of control circuits 100 and 200. A comparator 310 is coupled to the input terminal IN to detect a control signal $V_X$ for generating an enabling signal ENB at an output of the comparator 310. The enabling signal ENB is enabled once the control signal $V_X$ is higher than the first threshold $V_{T1}$. The enabling signal ENB is further connected to an input of an OR gate 350. Another input of the OR gate 350 is coupled to an output of a one-shot circuit 300 to receive a one-shot signal PLS. An output of the OR gate 350 generates a switching signal $S_X$. An input of the one-shot circuit 300 is connected to a start-up circuit 250 via an inverter 280. Two zener diodes 251 and, 252, a resistor 254, a transistor 255, a transistor 256 and a resistor 253 develop the start-up circuit 250 to generate a start-up signal $P_{ON}$ in response to the supply voltage $V_{CCX}$. The zener diodes 251 and 252 determine a start-up threshold. The start-up circuit 250 will enable the start-up signal $P_{ON}$ when the supply voltage $V_{CCX}$ is higher than the start-up threshold. In the mean time, the start-up signal $P_{ON}$ will turn on the transistor 255 to short circuit the zener diode 251 and produce a turn-off threshold. The turn-off threshold is determined by the zener diode 252. Therefore, the start-up signal $P_{ON}$ is disabled once the supply voltage $V_{CCX}$ is lower than the turn-off threshold. The switching signal $S_X$ is therefore generated in accordance with the one-shot signal PLS and the enabling signal ENB. The enabling signal ENB is connected to an inverter 315. The inverter 315 is connected to control a switch 322. The enabling signal ENB is used to control a switch 321. The switch 322 is coupled to the comparator 310 and the first threshold $V_{T1}$. The comparator 310 will compare the control signal $V_X$ with the first threshold $V_{T1}$ when enabling signal ENB is disabled. The switch 321 is coupled to the comparator 310 and the second threshold $V_{T2}$. The comparator 320 will compare the control signal $V_X$ with the second threshold $V_{T2}$ when enabling signal ENB is enabled.

FIG. 9 shows an embodiment of the one-shot circuit 300, in which a current source 410 and a capacitor 430 determine an enabling period of the one-shot signal PLS.

FIG. 10 shows another embodiment of the current mode resonant inverter according to the present invention. A resonant circuit is formed by a capacitor 70 and a transformer 85 to operate a lamp 50. The transformer 85 includes a first winding $M_1$ and a second winding $M_2$. The first winding $M_1$ of the transformer 85 is connected in series with the lamp 50. The second winding $M_2$ of the transformer 85 is used for providing supply voltages. Except for the transformer 85 providing the supply voltages, the operation of the current mode resonant inverters as shown in FIG. 10 and FIG. 2 are identical. The transformer 85 is an inductor having two windings. The resistor 45 is connected from an input voltage V+ to charge the capacitor 65 once the power is applied to the current mode resonant inverter. The capacitor 65 is further connected to provide a second supply voltage $V_{CC2}$ to the second control circuit 200. When the voltage across the capacitor 65 is higher than the start-up threshold, the second control circuit 200 will start to operate. The diode 60 is coupled from the second winding $M_2$ of the transformer 85 to the capacitor 65 to further power the second control circuit 200 once the switching of the resonant circuit starts. The diode 90 and the capacitor 95 form a charge-pump circuit. The charge-pump circuit is coupled to the capacitor 65 to provide a first supply voltage $V_{CC1}$ to the first control circuit 100.

While the present invention has been particularly shown and described with reference to preferred embodiments thereof, it will be understood by those of ordinary skill in the art that various changes in form and details may be made therein without departing from the spirit and scope of the present invention as defined by the appended claims.

What is claimed is:

1. A resonant inverter circuit, comprising:

a resonant circuit, formed by a capacitor and an inductor to operate a lamp;

a current transformer, coupled to said resonant circuit to generate control signals in response to a switching current of said resonant circuit;

control circuits, including a first control circuit and a second control circuit, for generating switching signals in response to said control signals;

a first transistor and a second transistor, coupled to said control circuits to switch said resonant circuit in response to said switching signals;

a capacitor, coupled to said current transformer to produce a supply voltage for said second control circuit;

a start-up resistor, wherein an input voltage charges said capacitor via said start-up resistor; and a charge-pump circuit, coupled to said capacitor to provide another supply voltage for said first control circuit; wherein said charge-pump circuit is operated in response to the switching operation of said first transistor and said second transistor.

2. The resonant inverter circuit as claimed in claim 1, wherein said switching signal is enabled once said control signal is higher than a first threshold; and said switching signal is disabled once said control signal is lower than a second threshold.

3. The resonant inverter circuit as claimed in claim 1, wherein said control circuit, comprises:

a comparator, coupled to said current transformer to generate an enabling signal in response to said control signal, wherein said enabling signal is enabled once said control signal is higher than said first threshold, and said enabling signal is disabled once said control signal is lower than said second threshold;

a start-up circuit, coupled to said supply voltage, for generating a start-up signal when said supply voltage is higher than a start-up threshold; and a one-shot circuit, coupled to said start-up circuit to generate a one-shot signal in response to said start-up signal, wherein said switching signal is generated in response to said one-shot signal and said enabling signal.

4. A resonant inverter, comprising:

a resonant circuit, formed by a capacitor and an inductor to drive a load;

a transformer, coupled to said resonant circuit to generate control signals in response to the switching operation of said resonant circuit;

control circuits, for generating switching signals in response to said control signals;

a first transistor and a second transistor, coupled to said control circuits to switch said resonant circuit in response to said switching signals; wherein said transformer provides a supply voltage for generating switching signals; and a start-up resistor, wherein an input voltage charges said capacitor via said start-up resistor.

5. The resonant inverter as claimed in claim 4, wherein said transformer is a current transformer.

6. The resonant inverter as claimed in claim 4, further comprising:

a capacitor, coupled to said transformer to produce said supply voltage for said control circuits; and a charge-pump circuit, coupled to said capacitor to provide another supply voltage;

wherein said charge-pump circuit is operated in response to the switching operation of said first transistor and said second transistor.

7. The resonant inverter as claimed in claim 4, wherein said switching signal is enabled once said control signal is higher than a first threshold; said switching signal is disabled once said control signal is lower than a second threshold.

8. The resonant inverter as claimed in claim 4, wherein said control circuit, comprises:

a comparator, coupled to said transformer to generate an enabling signal in response to said control signal, wherein said enabling signal is enabled once said control signal is higher than said first threshold, and said enabling signal is disabled once said control signal is lower than said second threshold;

a start-up circuit, coupled to said supply voltage to generate a start-up signal when said supply voltage is higher than a start-up threshold; and a one-shot circuit, coupled to said start-up circuit to generate a one-shot signal in response to said start-up signal, wherein said switching signal is generated in response to said one-shot signal and said enabling signal.

9. An inverter, comprising:

a resonant circuit, formed by a capacitor and a transformer to operate a lamp;

a current transformer, coupled to said resonant circuit to generate control signals in response to a switching current of said resonant circuit;

control circuits, for generating switching signals in response to said control signals;

a first transistor and a second transistor, coupled to said control circuits to switch said resonant circuit in response to said switching signals; wherein said transformer provides a supply voltage for generating said switching signals; and a start-up resistor, wherein an input voltage charges said capacitor via said start-up resistor.

10. The inverter as claimed in claim 9, further comprising:

a capacitor, coupled to said transformer to produce said supply voltage for control circuits; and a charge-pump circuit, coupled to said capacitor to provide another supply voltage;

wherein said charge-pump circuit is operated in response to the switching operation of said first transistor and said second transistor.

11. The inverter as claimed in claim 9, wherein said switching signal is enabled once said control signal is higher than a first threshold, and said switching signal is disabled once said control signal is lower than a second threshold.

12. The inverter as claimed in claim 9, wherein said control circuit comprises:

a comparator, coupled to said current transformer to generate an enabling signal in response to said control signal, in which said enabling signal is enabled once said control signal is higher than said first threshold, and said enabling signal is disabled once said control signal is lower than said second threshold;

a start-up circuit, coupled to said supply voltage to generate a start-up signal when said supply voltage is higher than a start-up threshold; and a one-shot circuit, coupled to said start-up circuit to generate a one-shot signal in response to said start-up signal, wherein said switching signal is generated in response to said one-shot signal and said enabling signal.

* * * * *